US009157290B2

(12) United States Patent
Habesland et al.

(10) Patent No.: US 9,157,290 B2
(45) Date of Patent: Oct. 13, 2015

(54) ARRANGEMENT, DEVICE AND METHOD FOR RESOLVING HYDRATE PLUGS

(75) Inventors: Geir Habesland, Oslo (NO); William Steffensen, Bergen (NO)

(73) Assignee: Hydratservices AS, Bergen (NO)

( * ) Notice: Subject to any disclaimer, the term of this patent is extended or adjusted under 35 U.S.C. 154(b) by 402 days.

(21) Appl. No.: 13/699,132

(22) PCT Filed: May 20, 2011

(86) PCT No.: PCT/NO2011/000157

§ 371 (c)(1),
(2), (4) Date: Jan. 9, 2013

(87) PCT Pub. No.: WO2011/145950

PCT Pub. Date: Nov. 24, 2011

(65) Prior Publication Data

US 2013/0199783 A1 Aug. 8, 2013

(30) Foreign Application Priority Data

May 20, 2010 (NO) ..... 20100740

(51) Int. Cl.

| | |
|---|---|
| ***E21B 36/04*** | (2006.01) |
| ***E21B 37/00*** | (2006.01) |
| ***E21B 23/14*** | (2006.01) |
| ***E21B 36/00*** | (2006.01) |

(52) U.S. Cl.
CPC ..... *E21B 23/14* (2013.01); *E21B 36/00* (2013.01); *E21B 36/04* (2013.01); *E21B 37/00* (2013.01)

(58) Field of Classification Search
CPC ..... E21B 36/04
See application file for complete search history.

(56) References Cited

U.S. PATENT DOCUMENTS

| | | | |
|---|---|---|---|
| 5,619,611 | A | 4/1997 | Loschen et al. |
| 6,343,652 | B1 | 2/2002 | Corre et al. |
| 6,651,744 | B1 | 11/2003 | Crawford |
| 2005/0284504 | A1 | 12/2005 | Kinnari et al. |

FOREIGN PATENT DOCUMENTS

| | | |
|---|---|---|
| UA | 14970 U | 6/2006 |

*Primary Examiner* — Giovanna C Wright
(74) *Attorney, Agent, or Firm* — Myers Bigel Sibley & Sajovec, PA

(57) ABSTRACT

An arrangement for resolving a hydrate plug (1) in a pipeline (2), such as tubing, drill pipe, casing etc., is described, said arrangement comprising a heating device (4) run on wire line. The heating device (4) is elongated and spear shaped and is mounted on a stroking device (3), the stroking device (3) being adapted to provide a pushing force of sufficient strength to force the heating device into the hydrate plug (1). The heating device then has a large surface towards the hydrate plug. When heat is applied to the heating device, the hydrate plug will melt. A hydrate inhibitor may be added to the liquid near the hydrate plug.

12 Claims, 4 Drawing Sheets

ARRANGEMENT, DEVICE AND METHOD FOR RESOLVING HYDRATE PLUGS

RELATED APPLICATIONS

This application is a 35 U.S.C. §371 national stage application of PCT Application No. PCT/NO2011/000157, filed on May 20, 2011, which claims priority from Norwegian Application No. 20100740, filed May 20, 2010, the contents of each of which are incorporated herein by reference in their entireties. The above-referenced PCT International Application was published as International Publication No. WO 2011/145950 A1 on Nov. 24, 2011.

FIELD OF THE INVENTION

The present invention relates to an arrangement, device and method for resolving hydrate plugs in oil wells and any pipeline transporting oil and gas, such as tubing, casing, drill pipe, drilling or production risers.

BACKGROUND

Hydrate plugs are sometimes formed in oil wells and pipelines transporting oil and gas. The plugs are apt to form in pipes where the pressure is high and the temperature low. This may in particular occur in offshore wells.

In order for hydrate plugs to form in wells, the following conditions must be present:

Access to free water (free water means water in liquid form as a separate phase or dispersed in the hydrocarbon phase).

Access to light gas molecules ($C_1$, $C_2$, $C_3$, $iC_4$, $CO_2$, $N_2$, $H_2S$).

Relatively high pressure.

Relatively low temperature.

Hydrates are mixtures of water (as ice) and methane gas. The methane gas occurs in cavities in the ice and changes the physical properties of the ice. The presence of methane will, inter alia, lower the melting point, but the most important effect is the release of gaseous methane when the hydrate is melting. The melting of the ice will lower the volume, but the released methane gas will increase the pressure (1 $m^3$ of ice can release up to 180 $Sm^3$ of gas).

Several methods exist for inhibiting the formation of hydrate plugs, but nevertheless hydrate plugs sometimes form, as mentioned above. Hydrate can cause problems in wells, process systems and transportation pipelines. Massive hydrates which close the flow cross section can cause serious operating problems.

Small amounts of hydrate formation can put valves out of function or hinder well operations. These problems can have serious safety and economic consequences.

Hydrate plugs can be expected to form in many types of operations, such as cable operations, coiled tubing, hydraulic pipeline pressure operations, pump operations, leak testing, pumping of well fluids, input and/or output of equipment/tools, shut down of flow lines/gas lift lines, perforation of tubing, flow operations, well cleaning and change of christmas trees.

The standard method for removing a hydrate plug is to inject Methanol (MeOH), mono ethylene glycol (MEG), triethylene glycol (TEG) or brine (KCl, NaCl, $CaCl_2$) and maintain relative high pressure at the top of the well. When injecting the hydrate inhibitor, it is important to note that it may be difficult (time consuming, days, weeks or even months) to get the inhibitor down to the hydrate plug, due to the long distance from the top of the well to where the hydrate plug is located.

In order to increase the efficiency of the chemicals and to reduce the fluid requirements, the chemicals may be delivered directly at the plug through coil tubing. However, it normally takes a long time to get coil tubing equipment mobilized and heavy coil tubing equipment must be lifted as "Heavy Lift" onto the rig. This means that critical weather limitations exist for heavy lift to be performed on platforms, especially onto semi-submersible rigs and Tension Leg Platforms (TLP). In addition to this, considerable time is needed to rig up the coil tubing equipment on the rig. A relatively large crew is also needed to operate the coil tubing equipment.

Another method is to drill through the plug by using coil tubing. But again, it normally also takes a long time to mobilize the coil tubing equipment and, again, the heavy coil tubing equipment is susceptible to the critical weather limitations for heavy lift onto similar platforms like semi-submersible rigs and (TLP) Platforms. Considerable time is also needed here to rig up the coil tubing equipment. A relatively large crew is also needed to operate the coil tubing equipment.

From U.S. Pat. Nos. 5,619,611 and 6,343,652 is known a method for unplugging pipes by lowering an electric heat device down to the plug. The heat device is mounted inside an encapsulation with a blunt end face. The heated end face will rest against the plug and melt it. Due to the small contact area between the tool and the plug, the heat transfer will be slow. The use of wire line tractors to transport the tool in deviated wells is also described. However, the tractors described are well known in the art but are too small to provide any appreciable force between the plug and the tool. There is also the danger of accidental release of the hydrate plug upwards due to high pressure from below. As far as we know, this method is currently not in commercial use.

SUMMARY OF THE INVENTION

An object of the present invention is to provide a new way of removing hydrate plugs that is more efficient, less costly and also more predictable then the above mentioned methods.

This is achieved in an invention according to the appended claims.

According to a first aspect, the invention comprises an arrangement for resolving a hydrate plug in a pipeline, said arrangement comprising a heating device mounted on a stroking device, wherein the heating device is elongate and spear shaped and the stroking device is adapted to provide a traction force of sufficient strength to force the spear-shaped heating device into the hydrate plug. Simultaneously, hydrate inhibitor liquid may be pumped in from the surface.

The stroking device is provided with anchors that will prevent the tool from being pushed out of the well when/if the hydrate plug releases from the tubing, casing, drill pipe or drilling-production riser due to high pressure from below the plug. Significant pressure may be present below the hydrate plug.

The arrangement will also be provided with two temperature sensors, one placed in the top of the tool and one placed in the bottom of the tool, that allow us to control the temperature in the heat device area and behind the tool in order to take action before the environment gets back to the critical stage regarding temperature.

The inventive device may also be provided with one hydrate inhibitor/water (density) sensor to measure the hydrate inhibitor/water concentration, so we can take action before the environment gets back to the critical stage regarding concentration hydrate inhibitor/water.

According to a second aspect, the invention comprises a heating device for use in an arrangement for resolving hydrate plugs, the device including a first section that is cylindrical and slightly tapered, a middle section that is conical, a cylindrical end section and at least one heating element inside at least one of said sections.

The heating device may also include centralizers from aft to 1-2 cm in front of the pip (heating element). The centralizers will form an angle in front where the edges will be coated with nano-diamonds.

According to a third aspect, the invention comprises a method for resolving a hydrate plug in a pipeline, wherein a spear-shaped heating device is forced into the hydrate plug and the hydrate plug is heated.

The method may include an additional step of injecting a hydrate inhibitor near the plug and mixing hydrate inhibitor and freed water from the plug, wherein an agitator is placed in or near the heating device. Freed water means water in liquid form as a separate phase or dispersed in the hydrocarbon phase.

BRIEF DESCRIPTION OF THE DRAWINGS

The invention will now be described in detail with reference to the appended drawings, where.

DETAILED DESCRIPTION

Figure 1:
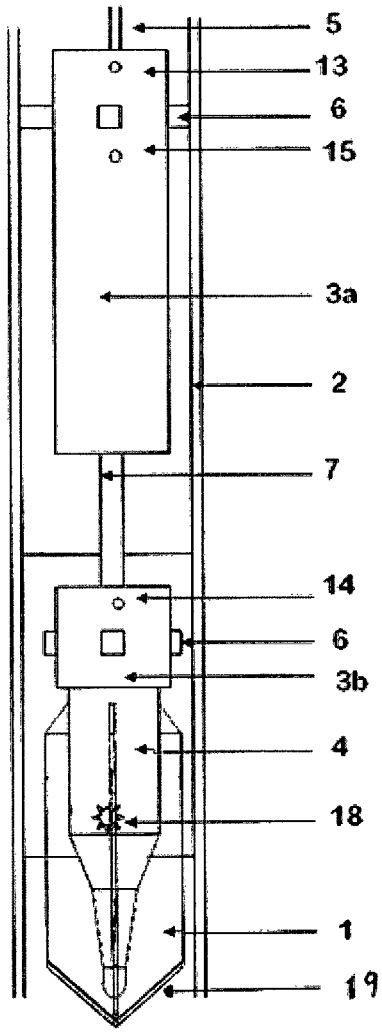
FIG. 1 shows the overall design of the inventive arrangement.

FIG. 1 shows an assembly according to the present invention in use in a pipe 2 which is obstructed by a hydrate plug 1. The assembly comprises a spear-shaped electric heating device 4 that is mounted on a stroking device or stroker. The assembly is connected to the surface through an electric wire-line 5. The electric wire-line 5 includes an electric cable supplying electric power to the device 4, as well as signal cables needed for controlling the assembly. The stroker shown in the figure includes first and second sections, 3*a, b*, with clamping devices 6 allowing each section to be anchored to the tube. The stroker includes a hydraulic cylinder/piston arrangement 7. When the first section 3*a* has been anchored to the pipe, the cylinder 7 may be expanded forcing the heating device 4 into the hydrate plug. Then, electric power may be applied to the device for melting the plug. As the spear-shaped device is forced into the plug, a large surface for transferring heat is obtained. The device should be arranged to conduct heat over the whole body, not just in the tip as in prior art arrangements.

The assembly may include an agitator 18. In the figure, the agitator is placed near the heating element, but it may be mounted anywhere on the tool. The agitator 18 includes a small propeller that may be run in both directions, which means that it may be reversed if the agitator should become clogged from debris present in the pipeline. The agitator may also be run periodically in alternate directions. The agitator serves to mix hydrate inhibitor and free water and to homogenize the temperature in the liquid mixture.

The assembly may be provided with a hydrate inhibitor/water sensor 15 that measures the hydrate inhibitor/water concentration in order to indicate when the injected hydrate inhibitor has been diluted and must be replenished.

The assembly may also be provided with two temperature sensors 13, 14, one 13 placed in the top of the tool and one 14 placed in the bottom of the tool, that allow us to control the temperature in the heat device area and behind the tool, so we can take action before the environment gets back to the critical stage regarding temperature.

In particular for deviated wells, the assembly could include a wire-line tractor. The tractor will ease transport along the well pipe.

It is essential for the invention to provide a large contact area between the heat body and the plug. Thus, the stroker must be able to confer substantial forces to the spear-shaped heating device in order to force it into the plug. A stroking device such as the Well Stroker (OD 2⅛"-3⅜") marketed by the company Welltec A/S can be modified for this purpose, even though a stroker from other suppliers may also be used. The stroker must not necessarily be as shown in FIG. 1. However, the stroker must be able to deliver a sufficient forward pressure on the heating device, 1-10 tons or more. At the same time it will be anchored to the pipe. A large forward pressure will slightly lower the melting point of the hydrate plug, but more important is that it may allow the device to break through the far end of the plug, and thus provide an even faster removal of the plug. The stroker should be securely anchored at all times to the pipe in case a high pressure has built up behind the plug.

The cable to the surface must be dimensioned to deliver sufficient electric power to the heating device, preferably in the range of 1.5 kW or more.

Figure 2:
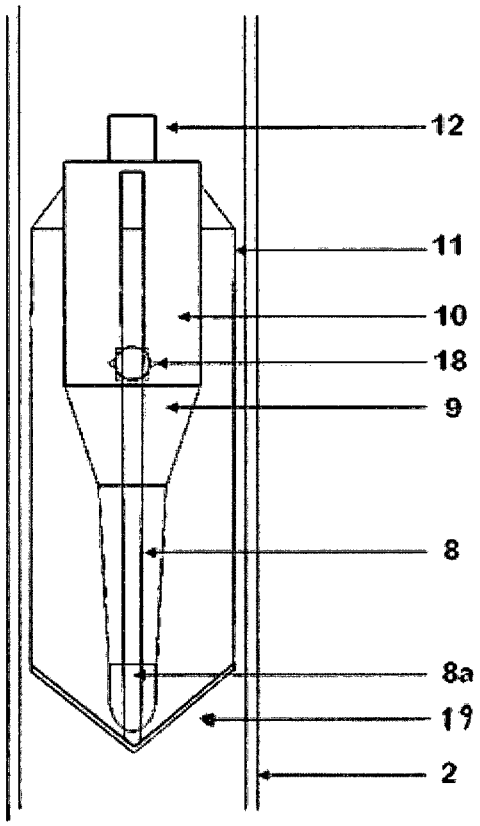
FIG. 2 shows the heating device in detail, FIG. 3 *a-e* is a sequence showing the invention in operation dissolving a hydrate plug in a pipeline.

FIG. 2 shows the heating device in detail. The device includes a slightly tapered cylindrical section 8 with a rounded tip 8*a*. The heating assembly also includes centralizers 11 from aft to 1-2 cm in front of the pip (heating element). The centralizers will form an angle in front where the edges will be coated with nano-diamonds 19. When forced into the hydrate plug, this front section with nano diamonds will cut into the plug and make larger contact area for the heating device radically. The front section is connected to a more steeply conical middle section 9. This again is connected to a cylindrical end section 10. All sections should be heated. The sections are hollow and one or preferably all sections should contain a heating device. In order to provide good thermal conduction from the element(s) into the hydrate plug, the elements may be filled with a heat conducting fluid. The device could be made from any metal of sufficient strength for the intended application, such as stainless steel, but should preferably be made from a metal that conducts heat well, such as copper. The heating device includes a number of wane shaped stabilizers with nano-diamonds 11. These will cut into the plug and also conduct heat into the hydrate plug. The end section 10 also includes means 12 for connecting to the stroker, such as a threaded contact.

FIG. 3 *a-e* illustrates the sequence of operations when removing a plug.

Figure 3A:
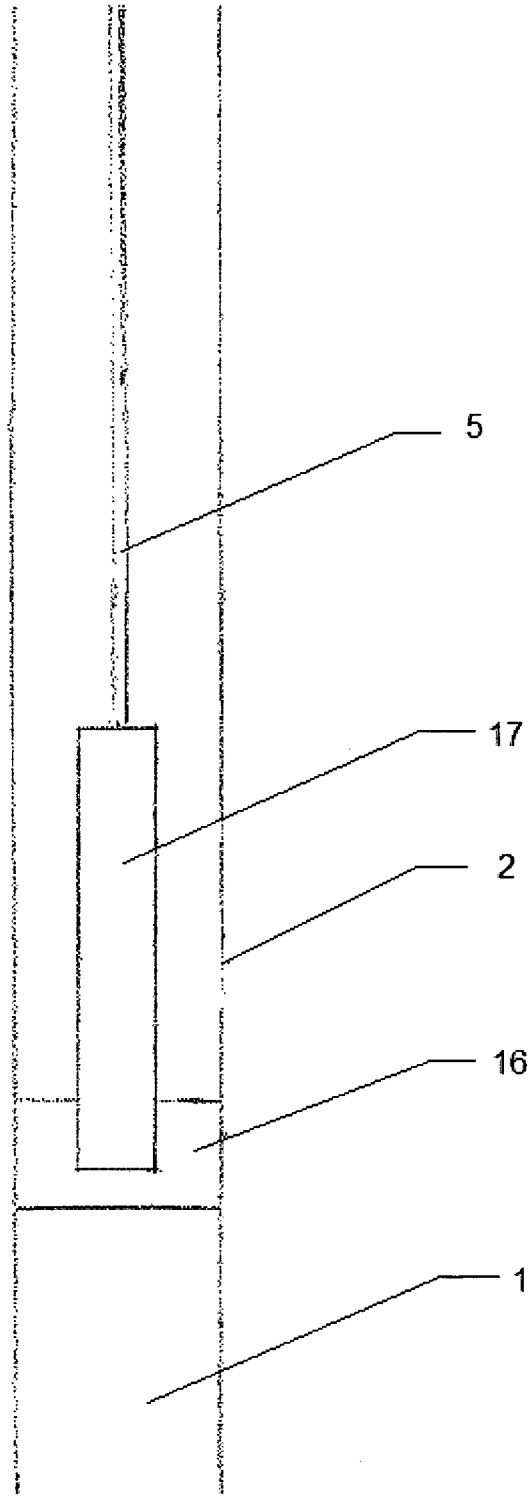
Figure 3B:
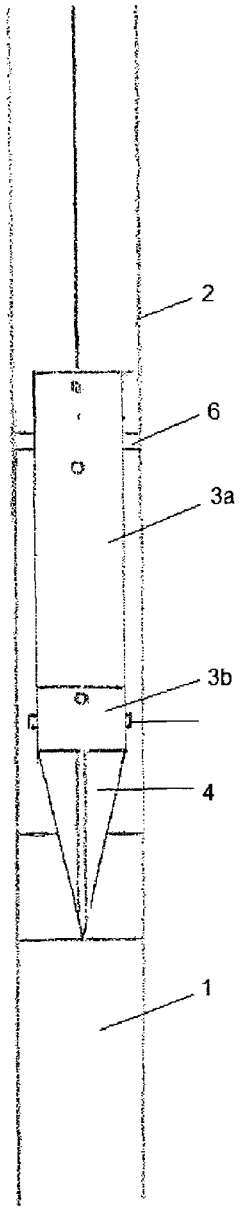
Figure 3C:
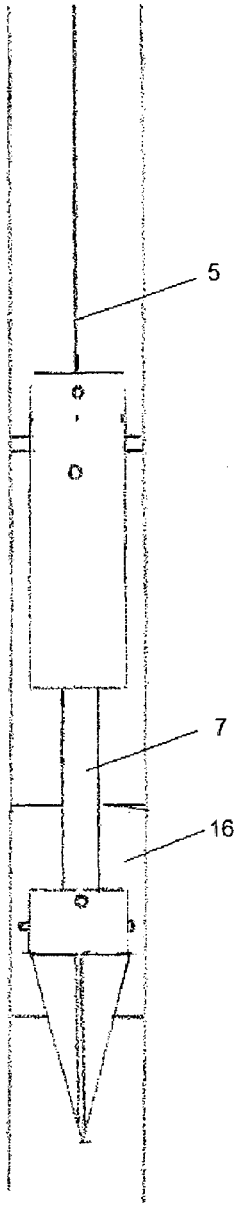
Figure 3D:
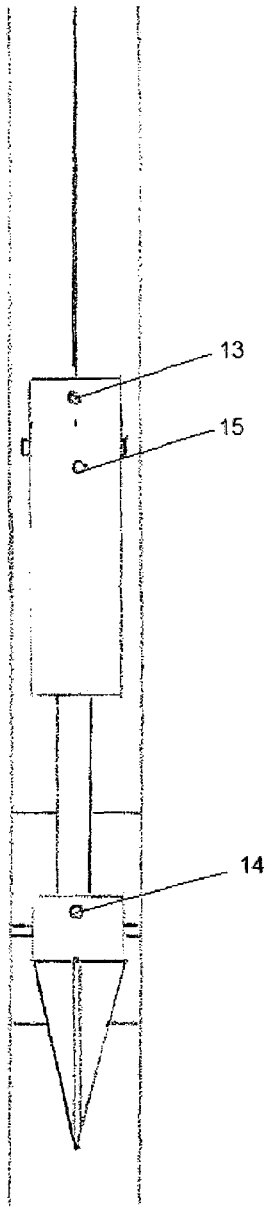
Figure 3E:
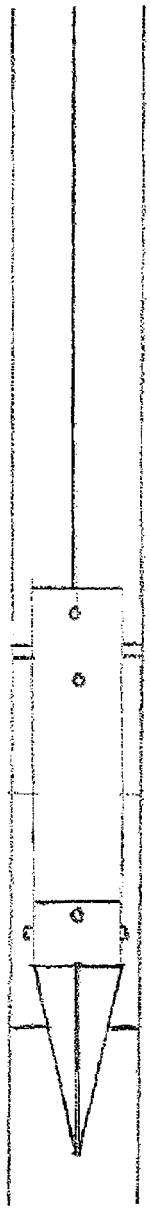

The sequence involves an initial step when the area 16 adjacent to the plug 1 is filled with hydrate inhibitor, from the surface or delivered from a so-called retainer 17, or preferably both, FIG. 3*a*. This hydrate inhibitor spot will replace the oil phase above the plug due to the hydrate inhibitor being denser than the oil phase. A retainer is a container with a suitable ejector mechanism, such as a valve, at the outlet and a piston. The retainer may be lowered to the plug on an electric wire-line 18, and is remotely operated from the surface.

The method may be described in technical detail as follows:

1. Start injection of hydrate inhibitor while waiting for wire line equipment to arrive at the rig.

(Sub-step 1; inject and pressure up the well with hydrate inhibitor to 5-30 bar above wellhead pressure.

Sub-step 2; wait for hydrate inhibitor to fall down into the oil phase.

Sub-step 3; bleed of oil phase to shut in pressure (5-30 bar)

Sub-step 4; repeat step 1 to 3 until rig up is complete.)

2. Rig up wire line and put in a retainer (FIG. 3*a*) filled with hydrate inhibitor (30-100 liters) to the tool string.
3. Run in hole with retainer down to hydrate plug, spot hydrate inhibitor on top of hydrate plug.
4. Pressure up well with hydrate inhibitor from top of the well, this will help to squeeze the hydrate inhibitor against/into the hydrate plug. Pressure is now kept on the well for the rest of the operation.
5. Pull out of hole and exchange retainer with inventive device.
6. Run inventive device down to hydrate plug.
7. Activate rear anchor on the stroker to the tubing wall, FIG. 3*b*.
8. Activate heating device and agitator device, let them work for a number of minutes. Record temperature in the top and bottom of tool area under whole operation. Regulate electric power to heat device if needed. Record hydrate inhibitor/water condition at all times until hydrate plug is melted.
9. Activate and extend stroker, FIG. 3*c*, start putting small force to heat device to drive it into hydrate plug. Record temperature.
10. When stroker is extended all the way, activate front anchor to tubing wall, FIG. 3*d*.
11. Deactivate then rear anchor.
12. Retract stroker, FIG. 3*e*.
13. When stroker is retracted, activate rear anchor to tubing wall.
14. Deactivate front anchor.
15. Go back to step 4, perform steps 9-14 until hydrate plug is removed.
16. If hydrate inhibitor has been diluted and must be replenished, go back to step 2-14.

The invention claimed is:

1. An arrangement for resolving a hydrate plug in a pipeline, said arrangement comprising:

a heating device run on wire line, wherein the heating device is elongated and spear shaped and is mounted on a stroking device, the stroking device being adapted to provide a pushing force of sufficient strength to force the heating device into the hydrate plug;

wherein the stroking device includes a first section and a second section and a cylinder/piston arrangement connecting the two sections, wherein both sections include anchoring devices enabling the sections to be anchored to the pipeline.

2. An arrangement as claimed in claim 1, wherein the stroking device is adapted to provide a sufficient pushing force on the heating device in the order of 1-10 tons or more.

3. An arrangement as claimed in claim 1, the arrangement further including a first temperature sensor at the heating element and a second temperature sensor adapted to measure the temperature in an area immediately behind the arrangement.

4. An arrangement as claimed in claim 1, the arrangement further including a sensor to measure the hydrate inhibitor/water concentration in order to indicate when the injected hydrate inhibitor has been diluted and must be replenished.

5. An arrangement as claimed in claim 1, the arrangement further including an agitator device.

6. An arrangement as claimed in claim 1, wherein the heating device includes a first section that is cylindrical and slightly tapered, a middle section that is conical, a cylindrical end section, at least one heating element inside at least one of said sections.

7. An arrangement as claimed in claim 6, wherein the heating device includes a number of heat-conducting stabilizers mounted along the heating device.

8. An arrangement as claimed in claim 7, wherein front edges of said stabilizers are covered with nano-diamonds.

9. An arrangement as claimed in claim 6, wherein the heating device is made from an appropriate heat-conducting metal compound.

10. A method for resolving a hydrate plug in a pipeline, the method comprising:

transporting an arrangement with a spear-shaped heating device and a stroking device to the plug, anchoring the stroking device to the pipeline, expanding the stroking device forcing the heating device into the hydrate plug, and heating the hydrate plug.

11. A method as claimed in claim 10, including the additional step of injecting an amount of hydrate inhibitor fluid at the plug.

12. A method as claimed in claim 11, wherein the hydrate inhibitor and freed water from the hydrate plug is agitated.

* * * * *